US005609479A

United States Patent [19]

Yoshida

[11] Patent Number: 5,609,479

[45] Date of Patent: Mar. 11, 1997

[54] FORCED COMPRESSION TYPE PUMP

[75] Inventor: Hirokazu Yoshida, Osaka, Japan

[73] Assignee: Japan I.D. Tech. Inc., Osaka, Japan

[21] Appl. No.: 522,305

[22] Filed: Aug. 30, 1995

[51] Int. Cl.[6] ..... F04C 2/344; F04C 5/00

[52] U.S. Cl. ..... 418/153; 418/156; 418/178; 418/225; 418/257

[58] Field of Search ..... 418/153, 156, 418/178, 225, 257

[56] References Cited

U.S. PATENT DOCUMENTS

| | | | |
|---|---|---|---|
| 1,265,070 | 5/1918 | Feyzes | 418/257 |
| 1,700,038 | 1/1929 | Feuerheerd | 418/153 |
| 1,762,418 | 6/1930 | Petersen | 418/257 |
| 1,974,122 | 9/1934 | Phillips | 418/257 |
| 2,068,570 | 1/1937 | Ross | 418/257 |
| 2,484,993 | 10/1949 | Gruber | 418/225 |
| 2,520,724 | 8/1950 | Jessop | 418/225 |
| 2,586,964 | 2/1952 | Kraissl, Jr. | 418/257 |
| 2,988,003 | 6/1961 | Schmied | 418/153 |
| 3,870,437 | 3/1975 | Gondek | 418/153 |
| 4,385,874 | 5/1983 | Savoie, Jr. | 418/225 |
| 4,958,992 | 9/1990 | Winiger | 418/29 |

FOREIGN PATENT DOCUMENTS

| | | | |
|---|---|---|---|
| 452935 | 11/1948 | Canada | 418/153 |
| 37-1475 | 2/1937 | Japan . | |
| 33-15505 | 9/1958 | Japan . | |
| 52-246 | 1/1977 | Japan . | |
| 56-92385 | 7/1981 | Japan | 418/257 |
| 59-190490 | 10/1984 | Japan . | |
| 1-158586 | 11/1989 | Japan . | |
| 654808 | 6/1951 | United Kingdom | 418/153 |

*Primary Examiner*—John J. Vrablik
*Attorney, Agent, or Firm*—Koda and Androlia

[57] ABSTRACT

A forced compression type pump including a cylindrically shaped pump case, an eccentric rotating body shaft-supported on said pump case at an eccentric position relative to said pump case and a compressing and forcibly sending member movable in a radial direction or said eccentric rotating body and adapted to be brought into press contact with the interior wall of said pump case, characterized in that the interior space is formed at the central part of said eccentric rotating body, a plurality of guide grooves are formed in a radial direction from said interior space to the circumferential surface of said eccentric rotating body, a plurality of circumferentially contacting cylindrical body inserted in said guide grooves and movable freely in a radial direction are formed, said plurality of circumferential contacting cylindrical body are in a planetary relationship relative to said central cylindrical body and the outer circumferential surfaces of said circumferentially contacting bodies are brought into press contact with the interior wall of said pump case while the circumferential surfaces of said circumferentially contacting bodies on their center sides are brought into press contact with said central cylindrical body, whereby said circumferentially contacting bodies are made to act as compressing and forcibly sending members.

4 Claims, 5 Drawing Sheets

FORCED COMPRESSION TYPE PUMP

FIELD OF THE INVENTION

This invention relates to a forced compression type pump including a cylindrically shaped pump case, an eccentric rotating body and a compressing and a compressing and forcibly sending member which press contacts with the interior wall of said pump case.

BACKGROUND OF THE INVENTION

As a forced compression type pump of this kind, "liquid and gas forced compression type pump" (Japanese Utility Model Application Publication Gazette No.55-184542) has been known.

Referring to FIG. 4, the above forced compression type pump includes a cylindrically shaped pump case A. an eccentric rotating body B shaft-supported on said pump case A at an eccentric position thereof and a compressing and forcibly sending member C which is movable in a radial direction of said eccentric rotating body B and is adapted to be brought into press contact with the interior wall of said pump case A, wherein said compressing and forcibly sending member C is composed of a rod-like roller 10 which is movable in a radial direction of said eccentric rotating body B and the volume of a forcibly sending member Q is reduced gradually from the inlet side 1 toward the outlet side 2 by rotation of said eccentric rotating body B so as to forcibly send gas or liquid.

In the above forced compression type pump which has already known, the difference in speed between the roller 10 and the roller support body 11 is big and accordingly the problem of much abrasion is involved.

SUMMARY OF THE INVENTION

In the present invention, an interior space is formed at the central position of an eccentric rotating body, a plurality of guide grooves extending radially from said interior space to the circumferential surface of said eccentric rotating body are formed and there are provided a central cylindrical body inserted in said interior space of the eccentric rotating body and a plurality of circumferentially contacting cylindrical bodies inserted in said guide grooves and movable freely in a radial direction. Under this arrangement, said plurality of circumferentially contacting cylindrical bodies are placed in a planetary relationship relative to said central cylindrical body, and the outer circumferential surfaces of said circumferentially contacting bodies are brought into press contact with the interior wall of said pump case while the circumferential surfaces of said circumferentially contacting bodies on their center sides are brought into press contact with said central cylindrical body, whereby said circumferentially contacting bodies are made to act as compressing and forcibly sending members.

DETAILED DESCRIPTION OF A PREFERRED EMBODIMENT OF THE INVENTION

Figure 2:
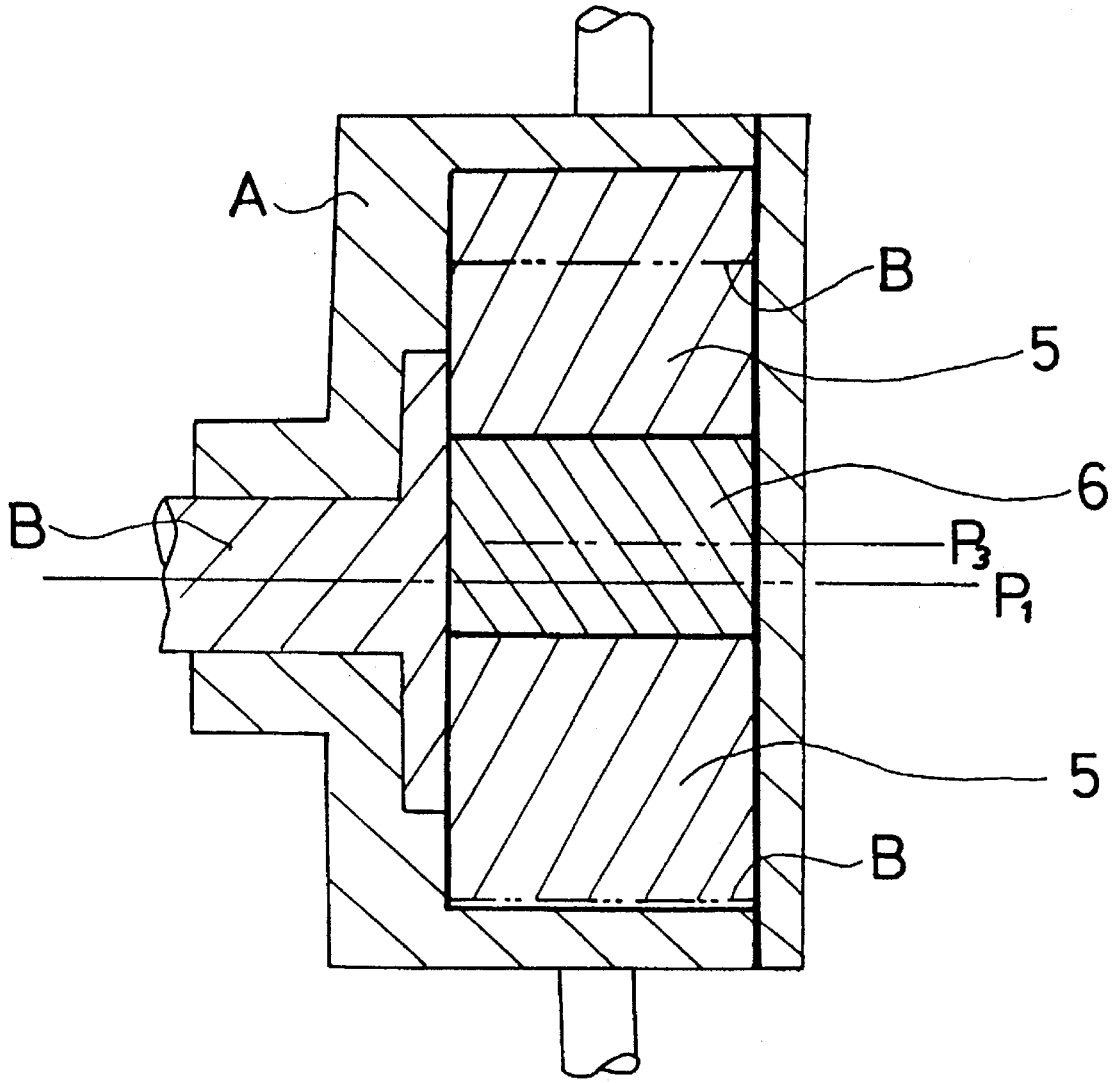
FIG. 2 is a cross section, taken along the 2—2 line in FIG. 1.
Figure 3:
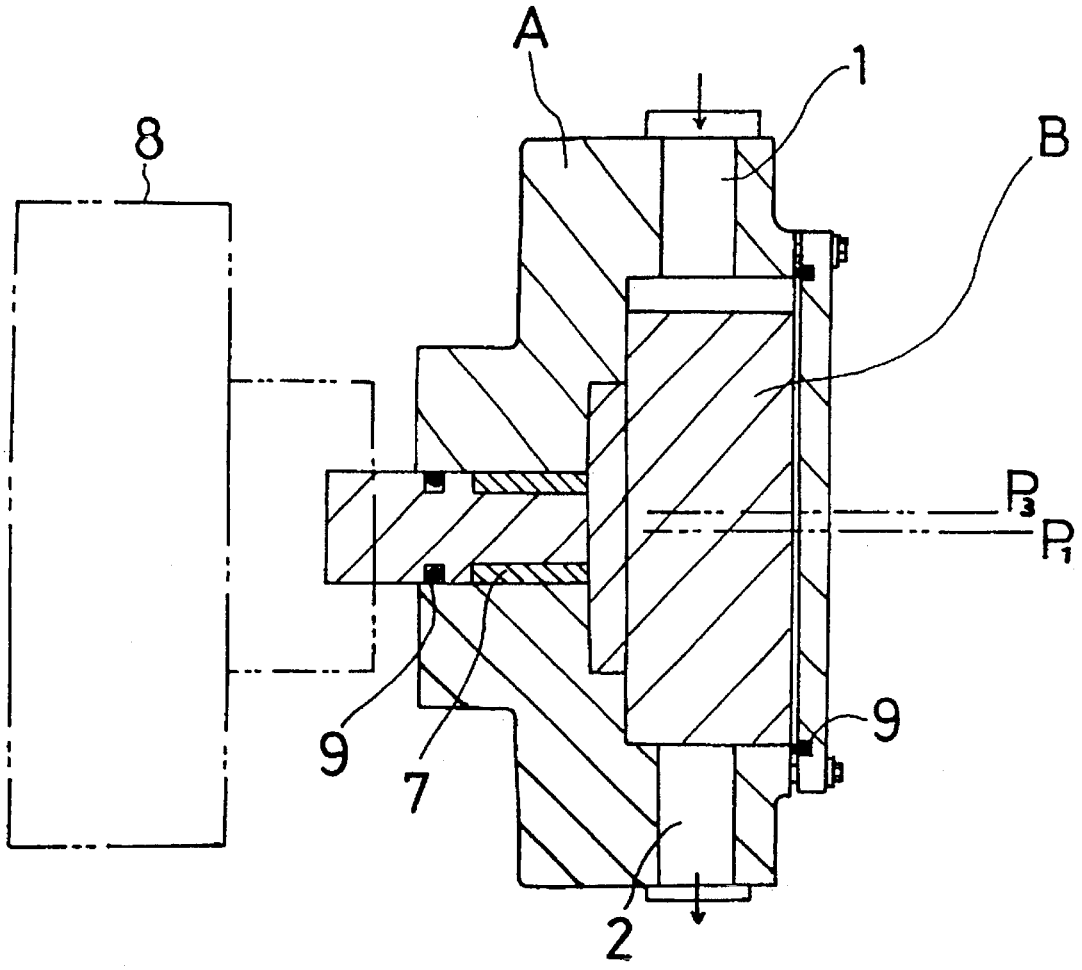
FIG. 3 is a vertical section (in a longitudinal direction in plane) of a forced compression type pump of the present invention.
Figure 4:
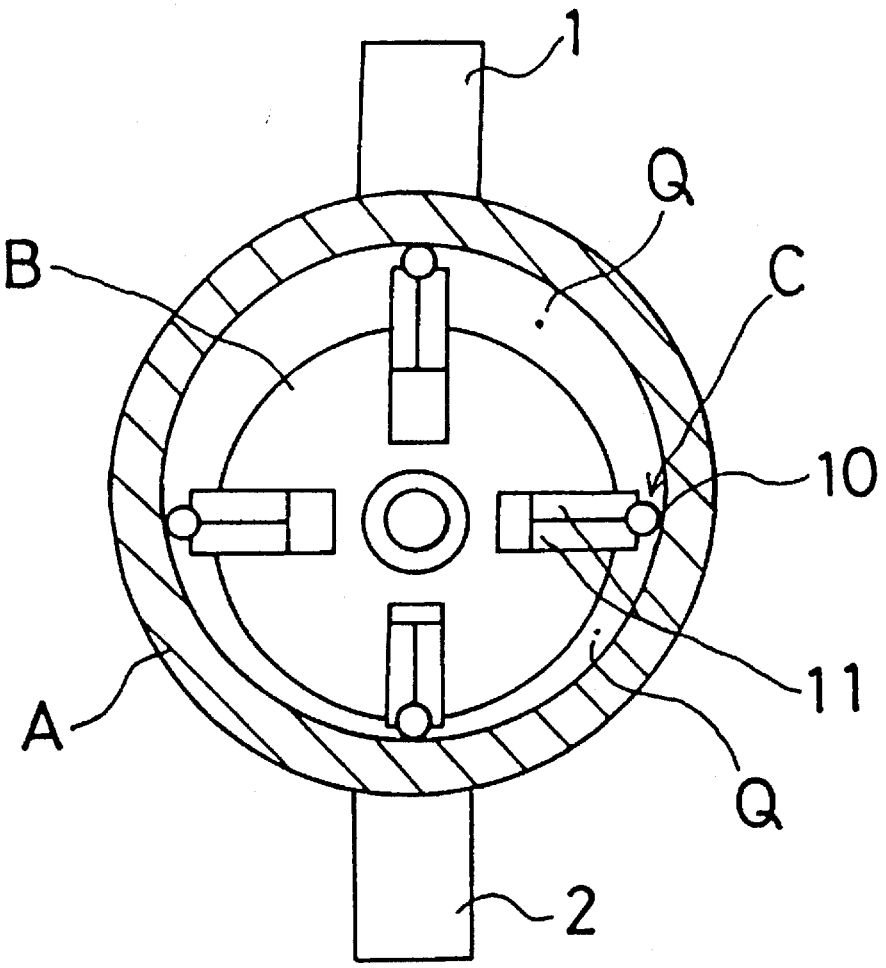
FIG. 4 PRIOR ART
FIG. 4 is a vertical section (similar to FIG. 1) of a known forced compression type pump.

The present invention is described below in detail, with reference to embodiments shown in FIG. 1–FIG. 3.

Similarly to the known forced compression type pump, a forced compression type pump of the present invention is composed of a cylindrically shaped pump case having an interior space, an eccentric rotating body shaft-supported on said pump case at an eccentric position thereof and a compressing and forcibly sending member movable in a radial direction of said eccentric rotating body and adapted to be brought into press contact with the interior wall of said pump case. However, in embodying the present invention, an interior space 3 is formed at the central position of said eccentric rotating body B and a plurality of guide grooves 4 extending radically from said interior space 3 to the circumferential surface of said eccentric rotating body B are formed, and there are provided a plurality of circumferentially contacting cylindrical bodies 5 that are inserted in said guide grooves 4 and are movable in a radial direction, with their axial center direction in parallel with the axial center of said eccentric rotating body B and a central cylindrical body 6 that is inserted in said interior space 3 and is circumferentially contacted with a plurality of cylindrical body 5. The outer circumferential surface of said circumferentially contacting cylindrical bodies 5 are brought into press contact with the interior wall of said pump case A and are made to act as compressing and forcibly sending members C.

Figure 1:
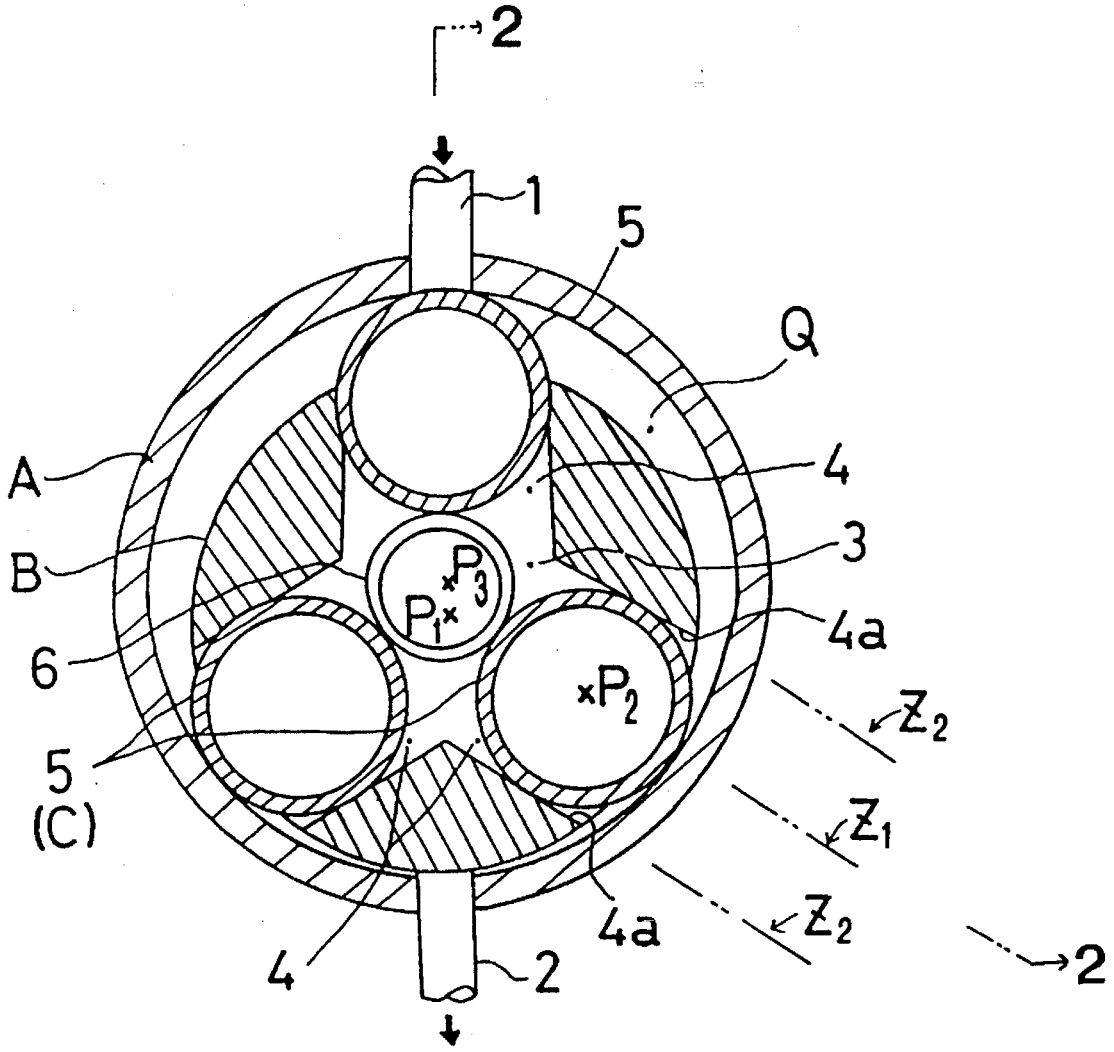
FIG. 1 is a vertical section (in a crossing direction in plane) of a forced compression type pump which is an embodiment of the present invention.

Referring to FIG. 1, a plurality of guide grooves 4 formed radically on said eccentric rotating body B are positioned in such a fashion that the extension line Z2 of the wall surface 4*a* of the guide groove 4 is in parallel with the line Z1 which passes through the axial center P1 of the eccentric rotating body B and the axial center P2 of the circumferentially contacting cylindrical body 5.

The eccentric rotating body B is shaft-supported on the pump case A in an eccentric position by a bearing 7 and is rotated by a driving gear 8. The eccentric rotating body B is in eccentric position relative to the pump case A but the central cylindrical body 6 is positioned at the axial center P3 of the cylindrically shaped interior space (in vertical section of the pump case A). In FIG. 3, numeral 9 denotes an O-ring for sealing.

While the eccentric rotating body B is turning, both the circumferential contacting cylindrical body 5 and the central cylindrical body 6 are rotating at all times and consequently, while the circumferential surface on the inner center side of the circumferential contacting cylindrical body 5 press contacts with the central cylindrical body 6 as it is rotating, the outer circumferential surface of the circumferential cylindrical body 5 press contacts with the interior wall of the pump case A as it is rotating. Thus, the interior wall of the pump case A and the circumferential contacting cylindrical body 5 are in the state of rotary friction to each other at all times.

By the rotation of the eccentric rotating body B, volume of the forcibly sending member Q is reduced gradually from the inlet side 1 toward the outlet side 2 so as to forcibly send gas or liquid.

Figure 5:
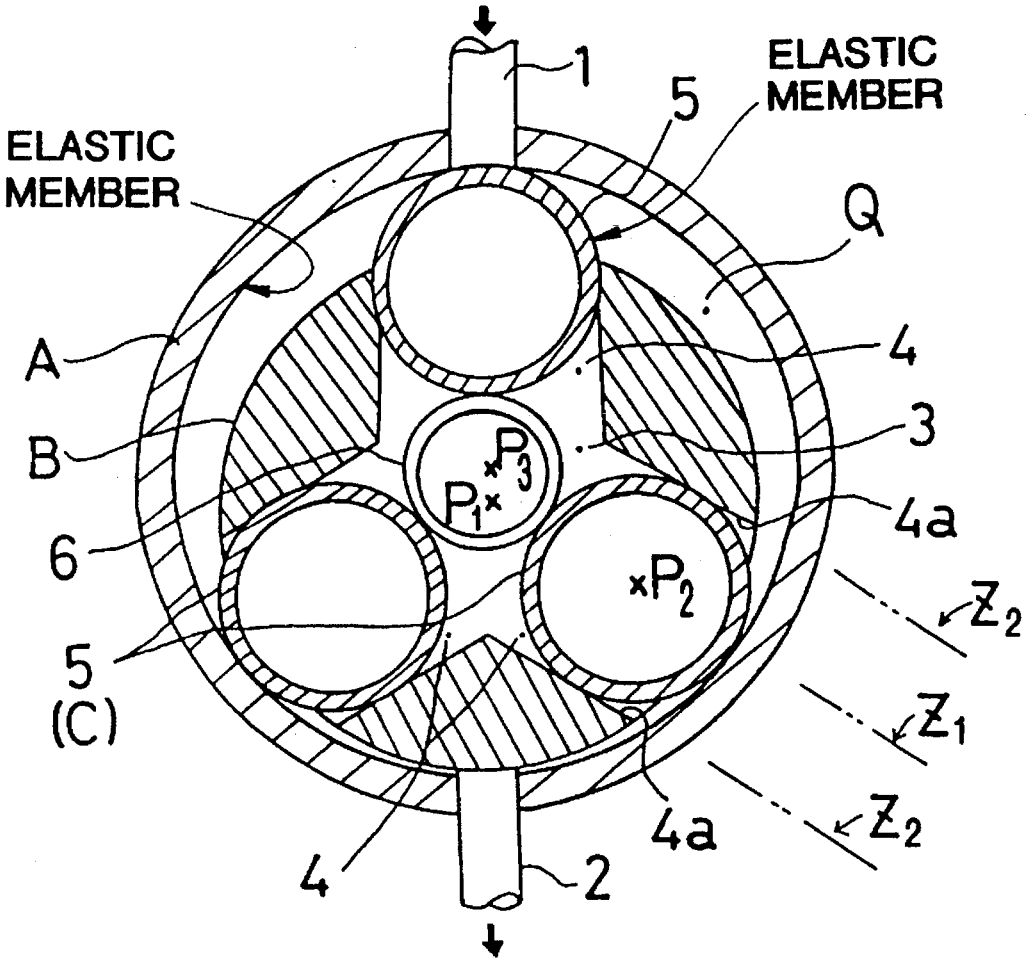
FIG. 5 is a vertical section of a forced compression type pump according to another embodiment.

If the interior wall surface which contacts at least with the circumferential contacting cylindrical body of the pump case is made of elastic member as shown in FIG. 5, it is convenient for slurry conveyance (conveying of fine grains) because the interior wall surface can be deformed elastically.

If the circumferential contacting cylindrical body 5 is an elastic member as shown in FIG. 5 or if it is cylindrically shaped and is elastically deformable, sealing effect on the interior space of the eccentric rotating body B can be heightened.

In this case, if the diameter of the circumferential contacting cylindrical body is made large in relation to the guide groove, it is deformed forcibly into elliptical shape with the result that it is reduced in its diameter and sealing effect can be heightened.

In addition, the cylindrical bodies are hollow cylinders, and three cylinders 5 are provided inside three guide grooves 4 and the central cylindrical body 6 divide the interior space 3 into three smaller spaces which are sealed off from each other. As a result, contacting pressure onto points on the outer circumferential surface of the cylindrical bodies that come into contact with the guide grooves 4 become different or unequal. Accordingly, a high sealing effect is obtained by the cylindrical bodies 5 relative to the inner wall surface of the pump and to the guide groove 4. In addition, wear or abrasion of the cylindrical bodies 5 decreases, making a practical use possible for the compression type pumps.

POSSIBILITY OF INDUSTRIAL UTILIZATION

As mentioned above, in the forced compression type pump according to the present invention the circumferential contacting cylindrical body which acts as the compressing and forcibly sending member moves in contact with the interior wall of the pump case while it is rotating at all times. Therefore, the circumferential contacting cylindrical body which acts as the compressing and forcibly sending member and the interior wall of the pump case are in the state of rotary friction to each other at all times. Also, as the circumferential contacting cylindrical body is controlled in its eccentric moving quantity by the guide groove of the eccentric rotary body and the central cylindrical body, the central cylindrical body and the circumferential contacting cylindrical body are in rotary contact with each other at a small speed difference and accordingly abrasion of both the interior wall of the pump case and the compressing and forcibly sending member is reduced considerably. As a result, the function of the forced compression type pump is kept semi-permanently and maintenance of the pump is facilitated.

What is claimed is:

1. A forced compression type pump including a cylindrically shaped pump case, an eccentric rotating body shaft-supported on said pump case at an eccentric position relative to said pump case and a compressing and forcibly sending member movable in a radial direction of said eccentric rotating body and adapted to be brought into press contact with the interior wall of said pump case, characterized in that an interior space is formed at a central part of said eccentric rotating body, a central cylindrical body disposed in said interior space, a plurality of guide grooves are formed in a radial direction from said interior space to a circumferential surface of said eccentric rotating body, a plurality of circumferentially contacting cylindrical bodies inserted in said guide grooves and movable freely in a radial direction are formed, said plurality of circumferential contacting cylindrical bodies are in planetary relationship relative to said central cylindrical body, outer circumferential surfaces of said circumferentially contacting bodies are brought into press contact with an interior wall of said pump case while said circumferential surfaces of said circumferentially contacting bodies on center sides thereof are brought into press contact with said central cylindrical body, each of said circumferentially contacting cylindrical bodies is a hollow cylinder, each of said circumferentially contacting cylindrical bodies has a diameter greater than a width of each of said guide grooves and each of said circumferentially contacting cylindrical bodies is deformed into an ellipse shape when compressed so that each of said circumferentially contacting bodies is reduced in diameter in a direction of a width of said guide groove and is expanded in a direction of length of said guide groove thus increasing a sealing effect of said eccentric rotating body with reference to said interior space whereby said circumferentially contacting cylindrical bodies are made to act as compressing and forcibly sending members.

2. The forced compression type pump as defined in claim 1, wherein a surface of said interior wall which makes contact at least with said circumferentially contacting cylindrical bodies is an elastic member.

3. The forced compression type pump as defined in claim 1, wherein each of said circumferentially contacting cylindrical bodies is an elastic member.

4. The forced compression type pump as defined in claim 1, wherein each of said circumferentially contacting cylindrical bodies is cylindrically shaped and is elastically deformable.

* * * * *

UNITED STATES PATENT AND TRADEMARK OFFICE

CERTIFICATE OF CORRECTION

PATENT NO. : 5,609,479

DATED : March 11, 1997

INVENTOR(S) : Hirokazu Yoshida

It is certified that error appears in the above-identified patent and that said Letters Patent is hereby corrected as shown below:

On the title page,
Item [22] Filed: Change "[22] Filed: Aug. 30, 1995"
to --[22] PCT Filed: Mar. 1, 1993--

On the title page,
Add Items [86] and [87] as follows:

--[86] PCT No.: PCT/JP93/00253

§ 371 Date: Aug. 30, 1995

§ 102(e) Date: Aug. 30, 1995

On the title page,

[87] PCT Pub. No.: WO94/20756

PCT Pub. Date: Sep. 15, 1994--

Signed and Sealed this

Tenth Day of June, 1997

*Attest:*

*Attesting Officer*

BRUCE LEHMAN

*Commissioner of Patents and Trademarks*